US006916053B2

(12) United States Patent
Lin

(10) Patent No.: US 6,916,053 B2
(45) Date of Patent: Jul. 12, 2005

(54) LATCH LOCK

(75) Inventor: Shih-Hung Lin, Taichung (TW)

(73) Assignee: Globe Union Industrial Corp., Taichung Export Processing Zone (TW)

( * ) Notice: Subject to any disclaimer, the term of this patent is extended or adjusted under 35 U.S.C. 154(b) by 4 days.

(21) Appl. No.: 10/452,386

(22) Filed: Jun. 3, 2003

(65) Prior Publication Data

US 2004/0245788 A1 Dec. 9, 2004

(51) Int. Cl.[7] ..... E05B 3/00

(52) U.S. Cl. ..... 292/336.3; 292/169; 292/169.16; 292/169.22; 292/336.5; 292/347; 292/348

(58) Field of Search ..... 292/336.3, 169, 292/169.14, 169.16, 169.22, 336.5, 347, 348, 357, 358, DIG. 30, DIG. 53, DIG. 64; 70/215–217, 224, 448, 449, 451

(56) References Cited

U.S. PATENT DOCUMENTS 565,108 A * 8/1896 Doebler ..... 292/348
2,743,600 A * 5/1956 Heyer ..... 70/479
2,995,396 A * 8/1961 Russell et al. ..... 292/169.22
3,899,204 A * 8/1975 Ulrich ..... 292/336.3
4,728,133 A * 3/1988 Valley ..... 292/336.3
5,364,139 A * 11/1994 Bergen et al. ..... 292/169
5,761,936 A * 6/1998 Katayama ..... 70/224
5,784,909 A * 7/1998 Huang ..... 70/224
5,813,708 A * 9/1998 Shen ..... 292/165
5,941,108 A * 8/1999 Shen ..... 70/467
6,141,998 A * 11/2000 Seo ..... 70/224
6,279,360 B1 * 8/2001 Shen ..... 70/224
6,357,270 B1 * 3/2002 Vazquez ..... 70/472
6,425,273 B1 * 7/2002 Kim et al. ..... 70/224
6,523,375 B2 * 2/2003 Beatty ..... 70/134
6,540,274 B2 * 4/2003 Bates et al. ..... 292/336.5
6,568,231 B1 * 5/2003 Huang ..... 70/468
6,598,440 B1 * 7/2003 Armstrong ..... 70/472
6,616,203 B1 * 9/2003 Lenk et al. ..... 292/336.3
6,626,018 B2 * 9/2003 Eller et al. ..... 70/224
6,634,196 B2 * 10/2003 Huang ..... 70/224
6,644,077 B1 * 11/2003 Huang ..... 70/468
6,681,605 B1 * 1/2004 Huang ..... 70/224
6,735,993 B2 * 5/2004 Eller et al. ..... 70/224

* cited by examiner

*Primary Examiner*—Daniel P. Stodola
*Assistant Examiner*—Carlos Lugo
(74) *Attorney, Agent, or Firm*—Leong C. Lei

(57) ABSTRACT

A structure for a latch lock that opens or closes a door without deadlocking it essentially comprised of a front body and a rear body each provided with a round plate locked into to each other with the latch bolt inside a recess of a door panel being placed in a space defined by both locked bodies; a rotation rod with a flange being each adapted to the front and the rear bodies having one end of the rotation rod inserted into a bolting hole in the latch bolt and the other end inserted with a reducing spring and a positioning ring for the rotation rod to be respectively inserted into the front and the rear bodies to allow spacing adjustment as desired to compromise door panel thickness.

3 Claims, 3 Drawing Sheets

LATCH LOCK

BACKGROUND OF THE INVENTION (a) Field of the Invention

The present invention is related to an improved latch lock, and more particularly to one that opens or closes a door without deadlocking it.

(b) Description of the Prior Art

Whereas, the thickness of a door panel in an average home is in a given specification, there are the cases that the thickness may vary depending on the design or manufacturing error. However, door latch locks generally available in the market are designed in a fixed specification. That is, the combination of a latch bolt with a front body and a rear body are provided in a fixed dimension that prevents from proper adjustment as required. Accordingly, the variance in the thickness of the door panel usually frustrates the installation of the latch lock.

SUMMARY OF THE INVENTION

The primary purpose of the present invention is to provide a latch lock that is adjustable by compromising the thickness of a particular door panel. To achieve the purpose, the present invention is comprised of a front body, a rear body and a latch bolt. An insertion part formed by multiple erected walls arranged in circle at a given spacing from one another are respectively provided to the front and the rear bodies for both bodies to lock into each other. A rotation rod inserted into the latch bolt is each provided in the front and the rear bodies. The rotation rod is adapted with a spring and a positioning ring. One end of the rotation rod penetrates together with the positioning ring through and out of the respective body for the positioning ring to engage with the body with a nut while the spring is provided between the latch bolt and the body. Accordingly, the spacing between the front and the rear bodies can be adjusted as desired depending on the thickness of the door panel to achieve the perfect installation of the latch lock.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
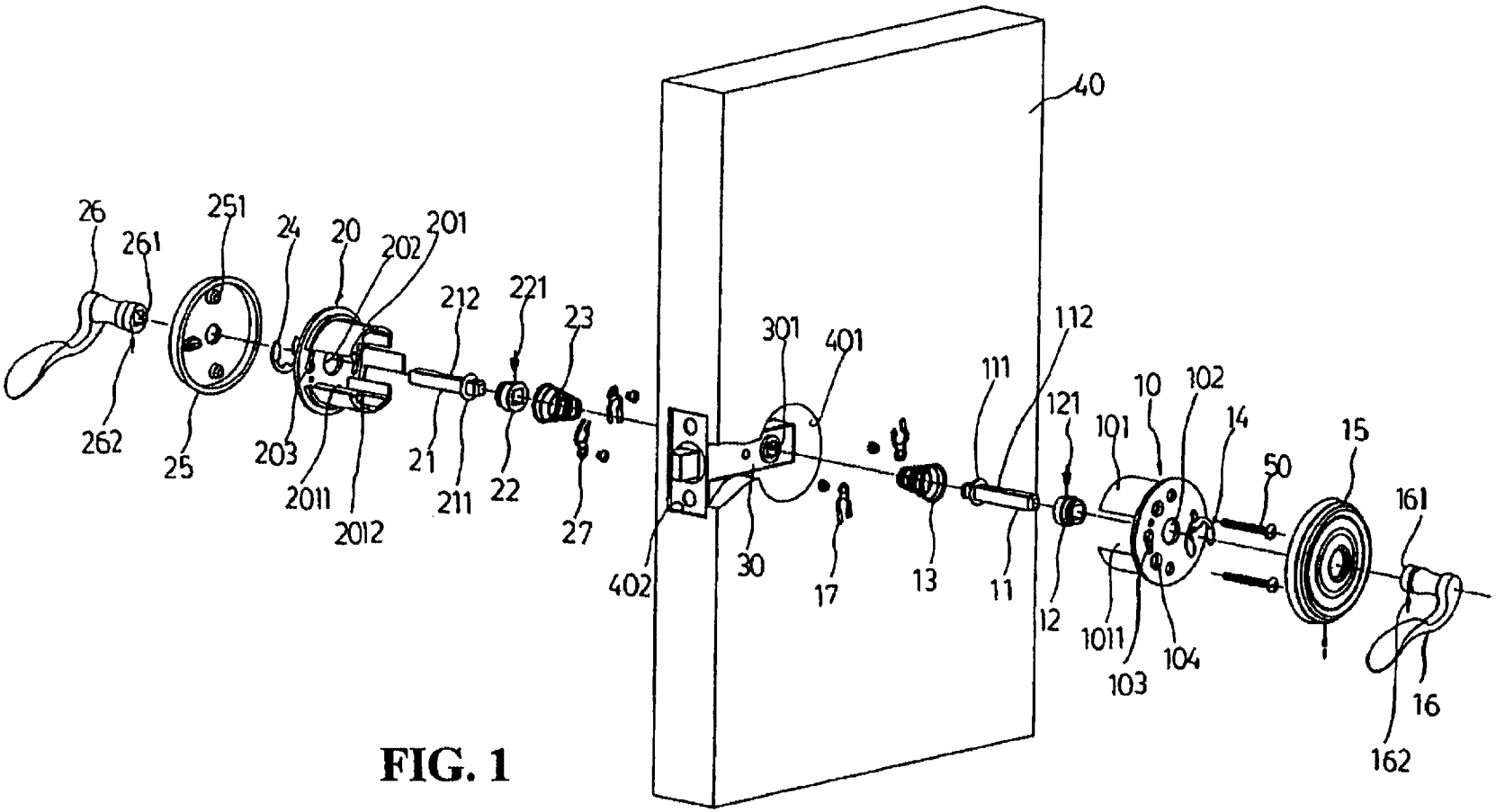
FIG. 1 is an exploded view of a preferred embodiment of the present invention.
Figure 2:
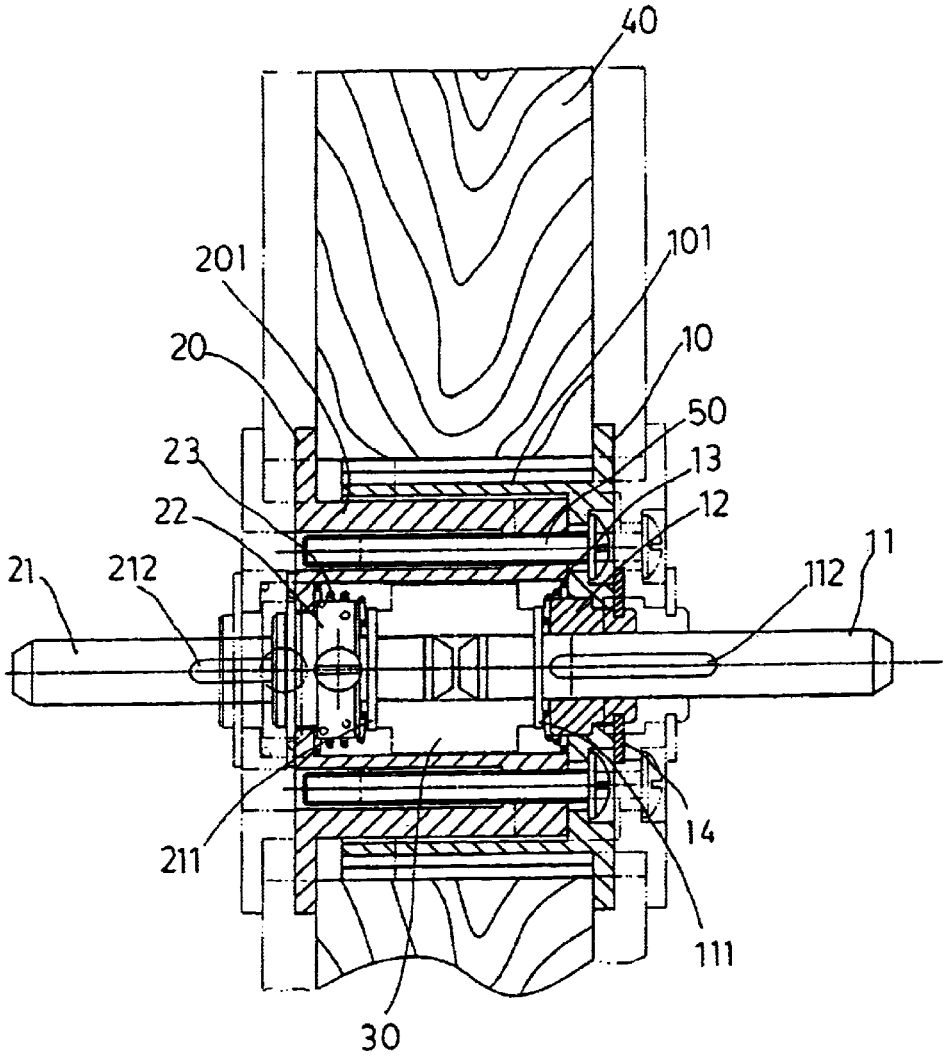
FIG. 2 is a schematic view showing the assembly process of the preferred embodiment of the present invention.
Figure 3:
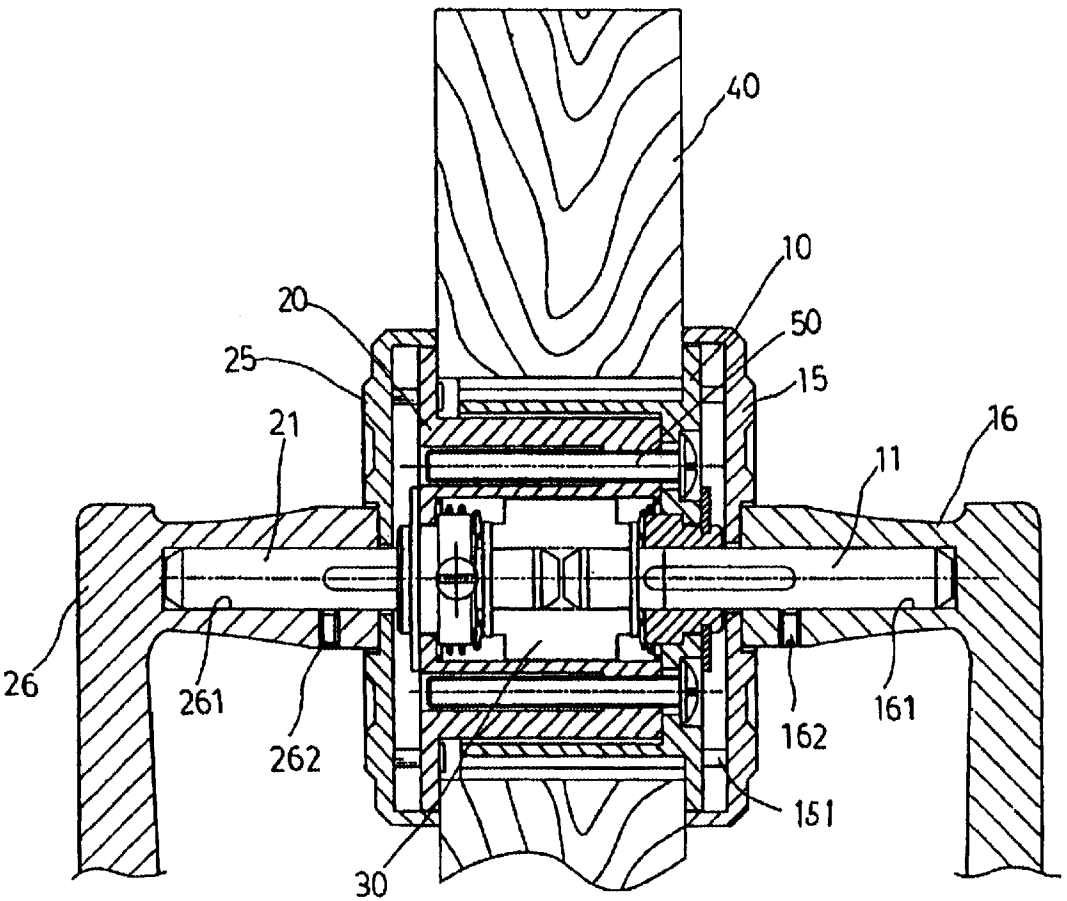
FIG. 3 is a schematic view showing the preferred embodiment of the present invention is completed with its assembly.

Referring to FIGS. 1, 2, and 3, a preferred embodiment of the present invention is essentially comprised of a front body 10, a rear body 20 and a latch bolt 30. The latch bolt 30 related to a prior art is first placed in a recess 402 of a door panel 40 with the head of the latch bolt exposed out of the door panel 40. A bolting hole 301 is provided at the terminal of the latch bolt 30 at where close to a locking hole 401 of the door panel 40 so to receive the insertion by a rotation rod. The front body 10 and the rear body 20 are designed in relative configuration and are respectively adapted with a rotation rod 11 (21), a positioning ring 12 (22), a spring 13 (23), a nut 14 (24), a rose 15 (25) and a handle 16 (26). Both of the front and the rear bodies 10, 20 are provided with insertion parts adapted with multiple erected walls arranged in circle at a given spacing from one another formed by multiple erected walls arranged in a circle at a given spacing from one another with the diameter of the insertion part 101 from the front body 10 greater than the insertion part 201 from the rear body 20 for the insertion part 201 to be inserted into the insertion part 101 while two gaps 1011, 2011 are respectively provided on the same side of both insertion parts 101, 201. When both of the front and the rear bodies are locked into to each other, the latch bolt 30 penetrates through both gaps 1011, 2011 of the insertion parts 101, 201 to execute retractable slide. Two axial holes 102, 202 are respectively provided at the center of the round plate of the front and the rear bodies 10, 20, and on both sides of the axial hole 102 (202) at where appropriately are each provided with a locking hole 103 (203) comprised of two holes in different diameters overlapped onto each other. A screwed hole 2012 is each provided on both sides of the insertion part 201 of the rear body 20 and two corresponding round holes 104 are provided on the round plate of the front body 10. Two bolts are used to incorporate both of the front and the rear bodies 10, 20. The rotation rod 11 (21) related to a square rod has a flange 111 (211) formed at where closes to the terminal of the rotation rod 11 (21), and a long positioning groove 112 (212) is provided on the surface of the rotation rod 11 (21) to allow the terminal of the rotation rod 11 (21) to be inserted into the bolting hole 301 of the latch bolt 30. Another end of the rotation rod 11 (21) is respectively inserted with a reducing conic spring 13 (23) immediately followed by the insertion of a graded positioning ring 12 (22). The gradation on the positioning ring 12 (22) is formed with two layers in different diameters, and a positioning bolt 121 (221) winds sideway into the layer in larger diameter of the gradation of the ring 12 (22) and deep into the positioning groove 112 (212) of the rotation rod 11 (21) without tightly packing against the rotation rod 11 (21) to allow the positioning ring 12 (22) slide for a certain distance in the groove 112 (212). Both rotation rods 11, 21 are respectively inserted through the axial holes 102, 202 in the front and the rear bodies 10, 20. Both of the layers in smaller diameter of the graded positioning rings 12, 22 also respectively penetrate through their corresponding axial holes 102, 202, and both of the layers in greater diameter of the graded positioning rings 12, 22 respectively hold against inside their corresponding axial holes 102, 202, then fastened respectively to the layers in smaller diameter of the graded positioning rings 12, 22 with a nut 14. Accordingly, both of the graded positioning rings 12, 22 are respectively fastened to corresponding axial holes 102, 202 and both springs 13, 23 are respectively provided between the round plates of the front and the rear bodies 10, 20 and their flanges 111, 211 to allow the front and the rear bodies 10, 20 to respectively slide on the rotation rods 11, 21 in a distance being subject to the length of the positioning groove 112, 212. Furthermore, two flexible clamps 17, 27 are respectively fixed inside the locking holes 103, 203 of the front and the rear bodies 10, 20.

Now referring to FIGS. 2 and 3, upon completing the assembly of the front and the rear bodies 10, 20, the terminals of the rotation rods 11, 21 are respectively inserted through their corresponding locking holes 401 in front of and behind the door panel 40 into the bolting hole 301 of the latch bolt 30 inside the recess 402 of the door panel 40. Both insertion parts 101, 201 of the front and the rear bodies 10, 20 are locked into to each other while pressure is applied on both round plates of the front and the rear bodies 10, 20 tightly against the door panel. Two bolts 50 are put through both round holes 104 of the front body 10, then through both screwed holes 2012 of the rear body 20 so to lock up both of the front and the rear body 10, 20 to the door panel. Both roses 15, 25 each provided with multiple studs 151, 251 on the inner side are respectively placed on the round plates of the front and the rear bodies 10, 20 for those studs 151, 251 to be merely inserted into the holes in greater diameter in those multiple corresponding latching holes 103, 203 provided on the round plate of the front and the rear bodies 10, 20. Both roses 15, 25 are turned to cause those multiple studs 151, 251 to falling into the holes in smaller diameter in those multiple corresponding latching holes 103, 203, and those multiple studs 151, 251 are tightly clamped by those flexible clamps 17, 27 respectively provided inside the latching holes 103, 203 to prevent those multiple studs from being displaced due to external force applied. Both handles 16, 26 each provided with a square connection hole 161, 261 are mounted with the insertion by both rotation rods 11, 21 and two screws 162, 262 are used to lock up both handles 16, 26 for the present invention to provide a latch lock with more particle benefits by allowing the most precise assembly of a latch lock applicable to door panels of various thickness.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure for a latch lock comprising: a front body, a rear body and a latch bolt, wherein, the front body and the rear body each being provided with an insertion part formed by multiple erected walls arranged in a circle at a given spacing from one another; both bodies being locked into to each other; the latch bolt provided inside a recess of a door panel being placed in a space defined by the locked bodies; front and rear rotation rods adapted with a flange at one end of the respective rotation rod; that end being inserted into a bolting hole of the latch bolt at a locking hole of the door panel; the other end of each rotation rod being inserted within a reduced conic spring and a graded positioning ring; the rotation rods being each penetrating through a respective axial hole of the front and the rear bodies to lack up the positioning ring with a nut in the axial hole; the springs being placed at the flanges of the rotation rods and at inner plates of the bodies; and both of the front and the rear bodies sliding on the rotation rods to adjust an insertion spacing between the front and the rear bodies that includes a thickness of the door panel; and roses and handles being eventually inserted to complete the assembly.

2. A structure for a latch lock as claimed in claim 1, wherein a positioning groove is provided to the rotation rod for the positioning ring to penetrate into the positioning groove by entering into the positioning bolt sideway.

3. A structure for a latch lock as claimed in claim 1, wherein multiple latching holes are provided on a round plate of the front and the rear bodies; multiple studs are provided on an inner side of each rose to engage into the latching holes to lock up both of the front and the rear bodies; and a square hole is each provided to both handles to receive insertion by the respective rotation rod.

* * * * *